US006616763B2

(12) United States Patent
Spatafora

(10) Patent No.: US 6,616,763 B2
(45) Date of Patent: Sep. 9, 2003

(54) DISPENSER DEVICE FOR DRYABLE FLUIDS

(75) Inventor: Mario Spatafora, Bologna (IT)

(73) Assignee: G. D. S.p.A., Bologna (IT)

( * ) Notice: Subject to any disclaimer, the term of this patent is extended or adjusted under 35 U.S.C. 154(b) by 0 days.

(21) Appl. No.: 09/970,784

(22) Filed: Oct. 5, 2001

(65) Prior Publication Data

US 2002/0040677 A1 Apr. 11, 2002

(30) Foreign Application Priority Data

Oct. 6, 2000 (IT) ..... BO2000A0578

(51) Int. Cl.[7] ..... B05B 3/00; B05C 5/00

(52) U.S. Cl. ..... 118/323; 118/302; 239/225.1; 239/106

(58) Field of Search ..... 118/302, 321, 118/322, 323; 239/104, 106, 225.1, 236, 99, 101, 115, 290, 294; 251/155, 88, 214; 131/112

(56) References Cited

U.S. PATENT DOCUMENTS 5,431,305 A * 7/1995 Kaminski ..... 222/109

5,746,356 A * 5/1998 Kieras ..... 222/212

* cited by examiner

*Primary Examiner*—Richard Crispino
*Assistant Examiner*—Yewebdar Tadesse
(74) *Attorney, Agent, or Firm*—Davidson Berquist Klima & Jackson, LLP

(57) ABSTRACT

A dispenser device for dryable fluids is positioned at a product packaging machine dispenser station, with a first conveyor for feeding pieces of packaging material through the dispenser station, and a second conveyor for feeding the products to be packaged; the dispenser device being between the first and the second conveyors and designed to dispense a dryable fluid, consisting of an adhesive substance, onto the pieces at the dispenser station; the device having a dispenser part, with a plurality of nozzles for dispensing the adhesive substance and being located in a cylindrical shell of a hollow body; the shell having an opening which is opposite the pieces in the dispenser station, and the dispenser part being mobile relative to the hollow body between an operating position, in which the nozzles are at the opening, and a non-operating position in which the nozzles are at least at a cleaning and/or washing station inside a sealed chamber formed by the dispenser part and the shell.

20 Claims, 4 Drawing Sheets

DISPENSER DEVICE FOR DRYABLE FLUIDS

BACKGROUND OF THE INVENTION

The present invention relates to a dispenser device for dryable fluids.

The present invention is advantageous when applied in the packaging machinery sector, particularly to packaging machines, to which the description below refers, although without limiting the scope of the invention.

In such machines, an adhesive substance must be distributed on given portions of sheets of a paper material, for example, blanks designed to be folded into the shape of containers or packets, or labels for application to the containers or packets.

The use of spray gumming units is known on packaging machines. The units are positioned opposite a feed line for sheets to be gummed and each unit comprises at least one spray gummer whose dispenser nozzle is connected to a supply circuit for an adhesive substance.

The spray gumming units of the above-mentioned type have the disadvantage of requiring frequent maintenance and cleaning on the dispenser nozzles, in particular because portions of the adhesive substance dry on the dispensers if the packaging machine is stopped temporarily and/or for a prolonged period.

Spray gumming units are known, in which the dispenser nozzle is moved from its operating position, in which it sprays the adhesive substance onto the sheets to be gummed, to a station close to which the nozzle is worked on by means designed to remove any dried portions of the adhesive substance, or to simply prevent said drying. Vice versa, said means may move towards the dispenser nozzle which remains substantially stationary in its operating position.

The above-mentioned relative movements of the dispenser nozzle and the means designed to remove dried portions of the adhesive substance require much room for maneuver, with the disadvantage of considerably increasing the overall dimensions of the packaging machine to which the gumming unit is attached.

Another disadvantage of the above-mentioned gumming units is the large number of moving parts, even during the steps in which the packaging machine is stopped.

SUMMARY OF THE INVENTION

The aim of the present invention is to provide a dispenser device for dryable fluids which overcomes the above-mentioned disadvantages and is at the same time functional, economical and compact.

Accordingly, the present invention provides a dispenser device for dryable fluids in a product packaging machine, the machine being of the type comprising a conveyor for feeding sheets of packaging material along a given feed path through a station at which said fluids are dispensed onto the sheet of material. The device comprises a hollow body with at least one opening close to the dispenser station, at least one dispenser part positioned at least partially inside the hollow body and at least one dispenser nozzle for the dryable fluids. The hollow body and dispenser part are mobile relative to one another between an operating configuration in which the nozzle is opposite the dispenser station through the opening, and a non-operating configuration in which the dispenser part and the hollow body form a sealed chamber housing the dispenser nozzle.

BRIEF DESCRIPTION OF THE DRAWINGS

The present invention will now be described with reference to the accompanying drawings, which illustrate several preferred embodiments without limiting the scope of the inventive concept, and in which.

DESCRIPTION OF THE PREFERRED EMBODIMENTS

Figure 1:
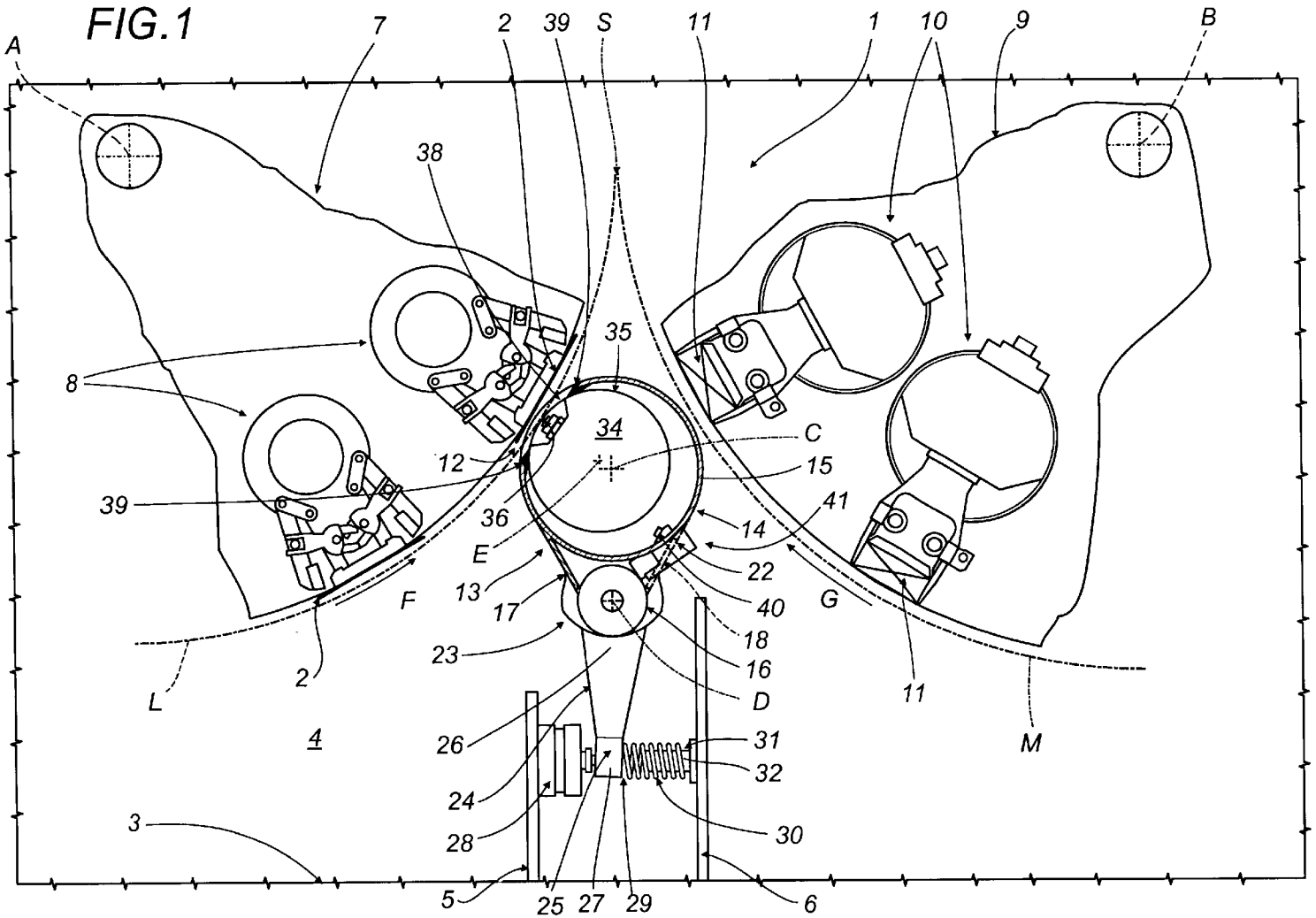
FIG. 1 is a schematic front elevation with some parts in cross-section and other parts cut away, of a portion of a packaging machine comprising a dispenser device made in accordance with the present invention.

With reference to FIG. 1, the numeral 1 denotes as a whole a portion of a generic product packaging machine, in particular for packaging products 11 using pieces 2 of packaging material, for example blanks.

The portion 1 comprises a base 3 supporting a vertical bottom wall 4 and two vertical walls 5, 6 transversal to the bottom wall 4 and parallel with one another.

The bottom wall 4 supports a first carrousel conveyor 7 with an axis of rotation A perpendicular to the bottom wall 4. The edge of the first carrousel conveyor 7 is equipped with a plurality of pick up parts 8 for the pieces 2 of packaging material, hereinafter referred to as blanks 2, for greater clarity.

The pick up parts 8 are of the known type and, therefore, are not described any further.

The first carrousel conveyor 7 turns about the axis A in the direction indicated by the arrow F, to feed the blanks 2 along a substantially circular first feed path L.

The bottom wall 4 supports a second carrousel conveyor 9 with an axis of rotation B parallel with the axis of rotation A of the first conveyor 7. The edge of the second carrousel conveyor is equipped with a plurality of pick up elements 10 for products 11, consisting, for example, of groups of cigarettes (not illustrated) wrapped in respective wrappers and ready to be united with the blanks 2 at a pairing station of the known type, schematically illustrated and labeled S in FIG. 1.

The second carrousel conveyor 9 turns about the axis B in the direction indicated by the arrow G, feeding the products 11 along a substantially circular second feed path M.

The first and second feed paths L, M are substantially tangential to one another at the pairing station S for the products 11 and blanks 2.

Along the first, blank 2 feed path L, between the first and second carrousel conveyors 7, 9 and close to the pairing station S, there is a dispenser station 12 for a dryable fluid, in particular consisting of an adhesive substance.

The dispenser station 12 comprises a dispenser device 13 for the adhesive substance, supported by the vertical wall 4 and designed to distribute the adhesive substance on the blanks 2.

The dispenser device 13 comprises a hollow body 14 comprising a substantially cylindrical shell 15, the bottom of which is connected to a tubular support body 16 by two connecting plates 17, 18, and which has an axis C parallel with the axis of rotation A of the carrousel conveyor 7.

Figure 2:
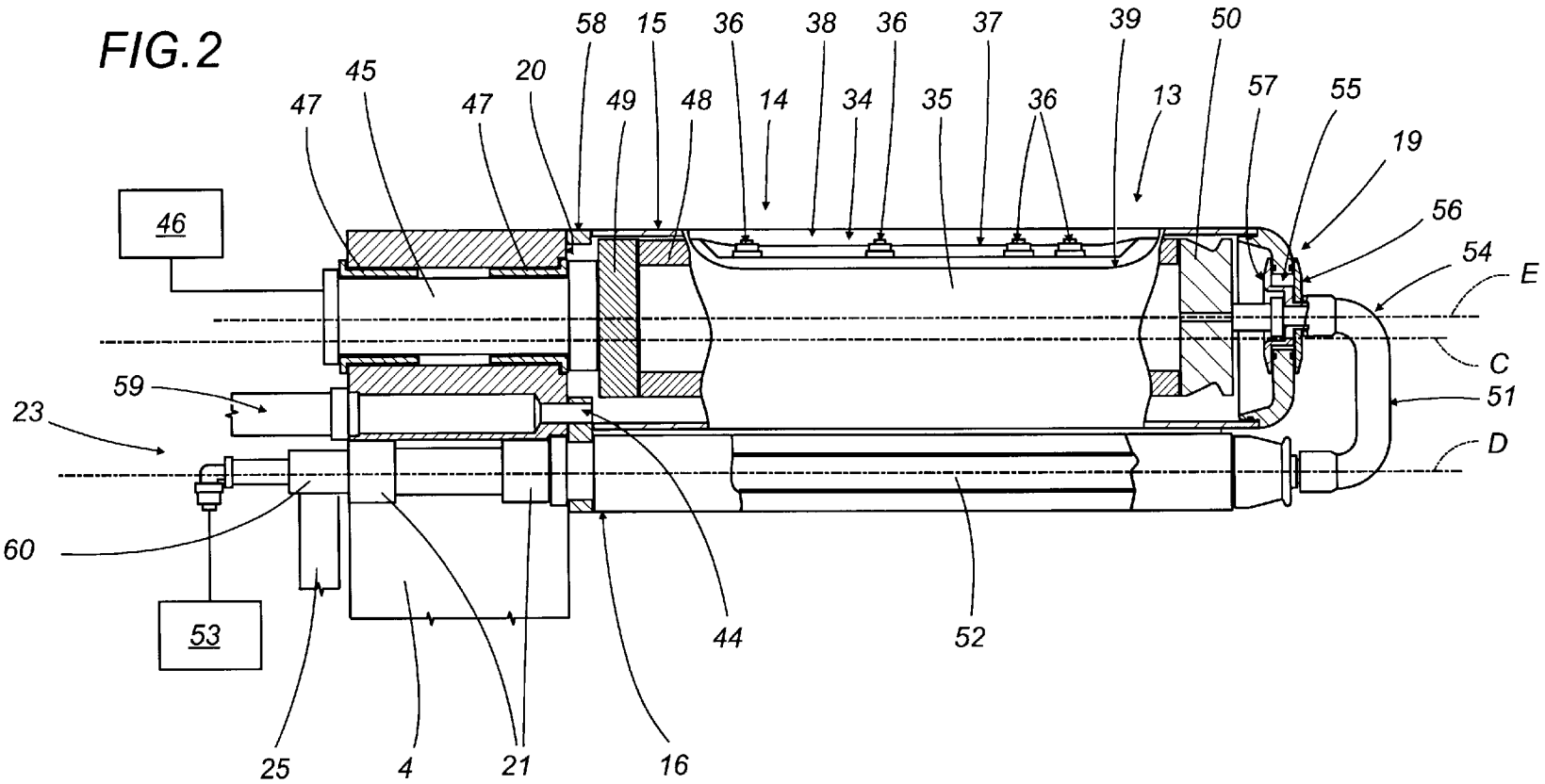
FIG. 2 is a schematic side view with some parts in cross-section and other parts cut away, of the device illustrated in FIG. 1.

As illustrated in FIG. 2, at the opposite longitudinal ends of the cylindrical shell 15, the hollow body 14 also comprises two closing walls 19 and 20, respectively front and back.

With reference to FIGS. 1 and 2, the tubular support body 16 has a longitudinal axis of rotation D parallel with the axis C of the shell 15 and pivots, at the longitudinal axis D, on the bottom wall 4 by means of a bush 21.

The hollow body 14 constitutes a first arm 22 of a rocker arm 23, pivoted at the tubular body 16 so that it oscillates about the axis D, and in which a second arm 24 is formed by a control lever 25. The control lever 25 is connected at one end 26 to the tubular body 16, whilst at the second end 27 the lever 25 engages with a pusher 28 supported by the transversal wall 5. On the side opposite the pusher 28, the end 27 of the lever 25 engages with a first end 29 of a return spiral spring 30, whose second end 31 is attached to the transversal wall 6 by a guide pin 32.

The dispenser device 13 also comprises a dispenser part 34 located inside the hollow body 14 and comprising a cylindrical manifold 35, with an axis E parallel with the axis of rotation A of the first carrousel conveyor 7. As illustrated in FIG. 2, the dispenser part 34 has a plurality of dispenser nozzles 36 for the adhesive substance, located on an external surface 37 of the manifold 35, in a line along a generatrix of the manifold 35.

The dispenser nozzles 36 are opposite the blanks 2 fed by the first conveyor 7 through a substantially elliptical opening 38 in the shell 15 at the station 12. In particular, the opening 38 extends mainly lengthways in a direction parallel with the axis C and, as is illustrated more clearly in FIG. 2, in an upper zone of the hollow body 14.

A seal 39 is fitted along the edge of the opening 38.

With reference to FIG. 1, the dispenser device 13 also comprises a station 40 for washing the adhesive substance dispenser nozzles 36. The washing station 40 is located in a lower zone 41 of the hollow body 14.

As illustrated in FIGS. 3 to 6, the washing station 40 comprises a plurality of sprayers 42 which emit a jet of washing fluid directed at the inside of the hollow body 14. The washing fluid contains water mixed with known solvent substances and is supplied by a source which is schematically illustrated in the accompanying drawings by a block labeled 43.

The washing station 40 also comprises an outlet 44 for the washing fluid, the profile of the outlet 44 being substantially elliptical, located downstream of the sprayers 42, relative to the above-mentioned jet of washing fluid.

As illustrated in FIG. 2, the dispenser part 34 is connected to the bottom wall 4 by a support and control shaft 45, coaxial with the cylindrical manifold 35 and rotated about the axis E, driven by a motor of the known type, schematically illustrated as a block 46 in the accompanying drawing. Plain bearings 47 of the known type are inserted between the shaft 45 and the bottom wall 4.

The manifold 35 comprises a cylindrical central body 48 on which the dispenser nozzles 36 are positioned and, to whose longitudinal ends, a first and second base 49 and 50 are sealed, respectively the front and back.

The first, back base 49 is rigidly connected to the support and control shaft 45, whilst the second, front base 50 has a hole drilled at its center to allow communication between the interior of the manifold 35 and a supply pipe 51 which carries the adhesive substance to the manifold 35. The pipe 51 comprises a first portion 52 which extends inside the tubular body 16 and is connected to a supply device for the adhesive substance, schematically illustrated with a block 53; and a second, connecting portion 54, which connects the tubular body 16 to the manifold 35, passing through the hollow body 14 close to its front closing wall 19.

The front closing wall 19 has a substantially central slot 55, in which the second, connecting portion 54 of the supply pipe 51 can move as a result of the oscillation of the rocker arm 23.

The second portion 54 has two flanges 56, 57 positioned on opposite sides of the front closing wall 19, engaging to form a seal with the wall 19 and maintaining said seal even during the relative movements between the cylindrical manifold 35, with which the flanges 56, 57 are integral, and the closing wall 19 of the hollow body 14.

The back closing wall 20 of the hollow body 14 substantially consists of a portion of the bottom wall 4 with which the shell 15 engages by means of one of its back ends 58, fitted with a seal.

The outlet 44 is made in the back closing wall 20 and is connected to a drainage pipe 59 for the washing fluid.

As described above with reference to the shaft 45, the tubular body 16 is also mounted on the bottom wall 4 by the insertion of plain bearings 47 of the known type.

On the opposite side of the bottom wall 4, relative to the tubular body 16, the tubular body 16 has a portion 60 which is rigidly connected to the control lever 25 for the oscillations of the rocker arm 23.

Figure 3:
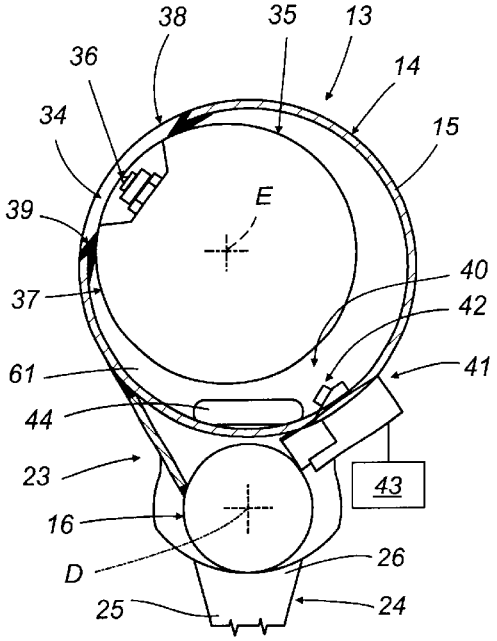
FIGS. 3 through 6 are schematic front views with some parts in cross-section and other parts cut away, of the device illustrated in FIG. 1, in a succession of operating steps.

In practice, with reference to FIG. 3, in which the dispenser device 13 is illustrated in a first gumming step, the hollow body 14 and the dispenser part 34 adopt a first, operating configuration. In this operating configuration, the adhesive substance dispenser nozzles 36 are opposite one of the blanks 2, supported by a pick up part 8 illustrated in FIG. 1.

As illustrated in FIG. 3, the opening 38 is in the position close to the dispenser part 34, so that by the contact between the seal 39 and the outer surface 37 of the cylindrical manifold 35, it forms a sealed chamber 61 inside the hollow body 14.

Figure 4:
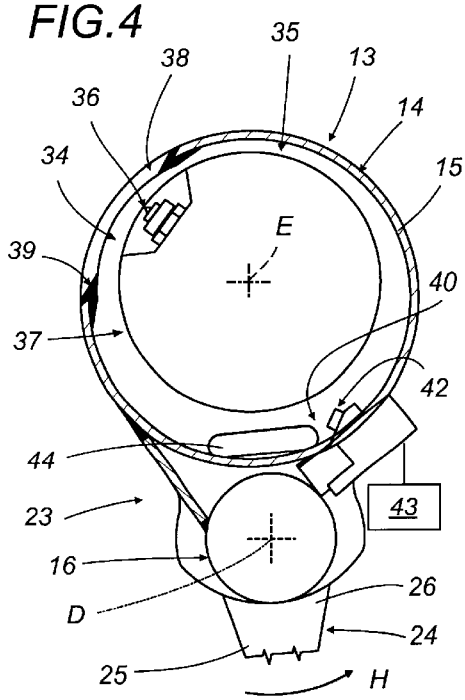

FIG. 4 illustrates the dispenser device 13 during its second step, of detaching the seal 39 from the outer surface 37 of the cylindrical manifold 35.

During this detachment step, the elliptical opening 38, together with the hollow body 14 in which it is made, assumes a position which is distanced from the dispenser part 34, by oscillation of the rocker arm 23, of which the hollow body 14 is an integral part. As a result of the seal 39 being detached from the outer surface 37 of the manifold 35, the sealed chamber 61 no longer exists, since its interior is put into communication with the outside environment.

The above-mentioned oscillation of the rocker arm 23 occurs about the axis D of the tubular body 16 and in the direction indicated by the arrow H by means of the control lever 25 activated by the pusher 28 illustrated in FIG. 1.

Figure 5:
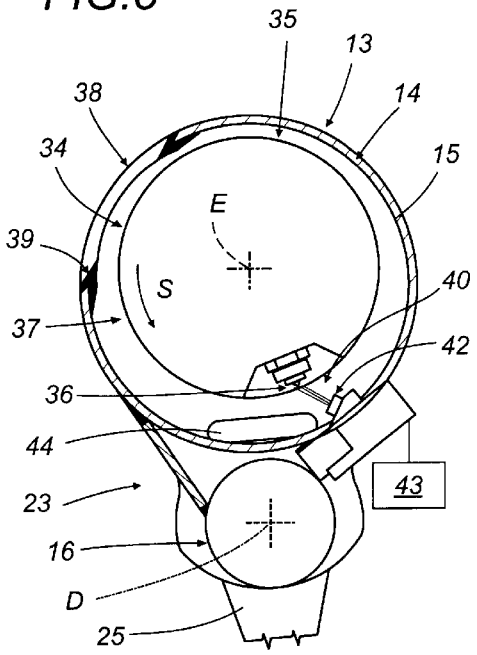

FIG. 5 shows the dispenser device 13 during a third step of rotation of the dispenser part 34, bringing the adhesive substance dispenser nozzles 36 to the washing station 40.

This rotation occurs about the axis E of the manifold 35 in the direction indicated by the arrow R, driven by the motor 46 illustrated in FIG. 2.

Figure 6:
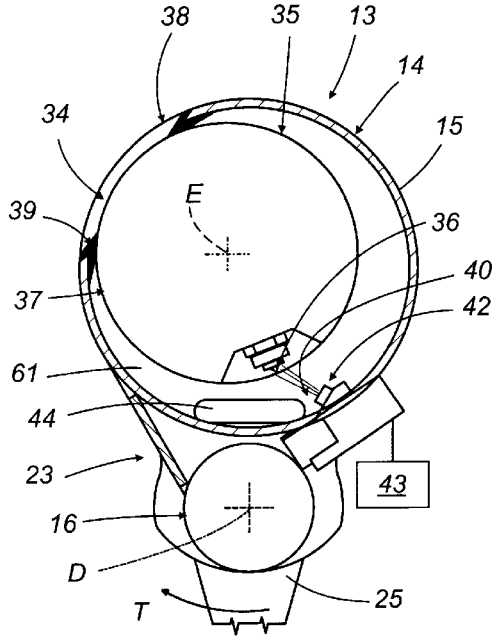

FIG. 6 illustrates the dispenser device 13 during a washing step, in which the hollow body 14 and the dispenser part 34 adopt a non-operating configuration, as regards the gumming operations.

Before this washing step, by means of a fourth rotation step of the rocker arm 23 in the direction indicated by the arrow T, the elliptical opening 38 assumes the position close to the dispenser device 34, again, by contact of the seal 39 with the outer surface 37 of the cylindrical manifold 35, forming the sealed chamber 61 inside the hollow body 14.

During the subsequent fifth, washing step, the washing fluid sprayers 42 are each pointed at an adhesive substance dispenser nozzle 36, so that they emit, at a relatively high pressure, a jet of washing fluid designed to forcefully remove from the dispenser nozzle 36 any dried portions of the adhesive substance and/or prevent such drying of the substance.

Advantageously, the sealed chamber 61 contains the washing fluid which is forcefully aimed at the nozzles 36, preventing the fluid from wetting and/or dirtying the parts of the portion 1 of the packaging machine which are close to the stations 12 and 40.

After hitting the dispenser nozzle 36, the washing fluid from the sprayers 42 and any residues of dried adhesive substance removed drop, due to gravity, to the lowest part of the cylindrical shell 15 which forms the hollow body 14 and are collected by the outlet 44 for drainage.

From the above description, it is evident that the operating steps described occur one after another with minimal movements of the dispenser device 13 close to the station 12. As a result, the device 13 requires relatively limited room for maneuver close to the station 12, with obvious advantages in terms of the overall dimensions of the above-mentioned packaging machine.

Figure 7:
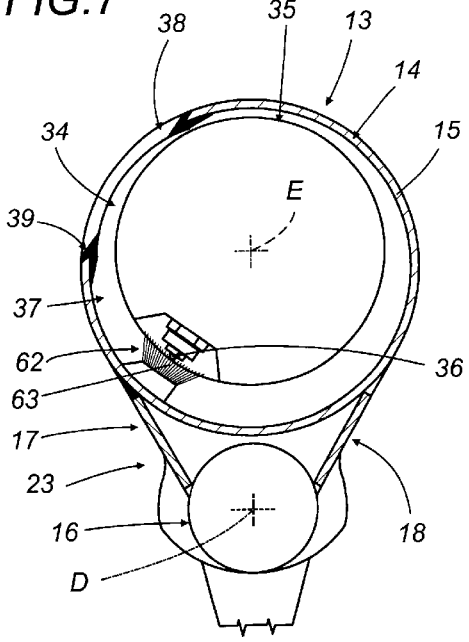
FIGS. 7 through 10 are schematic front views with some parts in cross-section and other parts cut away, of alternative embodiments of the device illustrated in FIG. 1.

As illustrated in FIG. 7, in an alternative embodiment, the dispenser device 13 has a cleaning station 62 comprising a brush 63 mounted inside the shell 15 and opposite the dispenser part 34. Following a rotation of the dispenser part 34 manifold 35 about its axis E, the brush 63 is designed to engage with each of the dispenser nozzles 36 to remove any adhesive substance residues from the nozzles 36.

Figure 8:
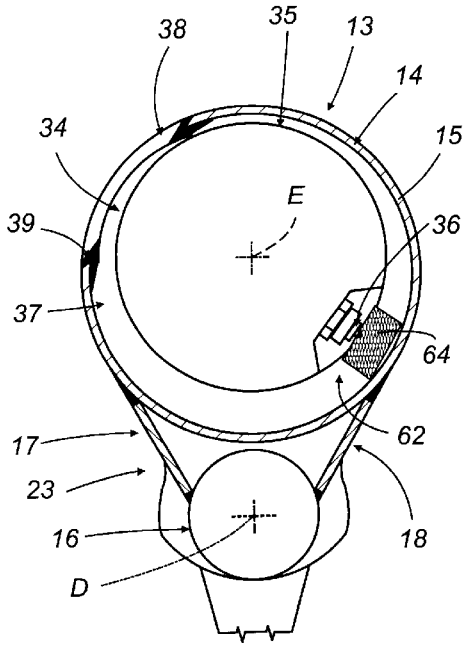

FIG. 8 illustrates another embodiment of the dispenser device 13, in which the cleaning station 62 comprises a pad 64, which is impregnated, in a known way, not illustrated, with a substance which dampens and/or prevents drying, such as silicone oil, and is designed to engage with each of the nozzles 36, to keep them closed in the body 14.

Figure 9:
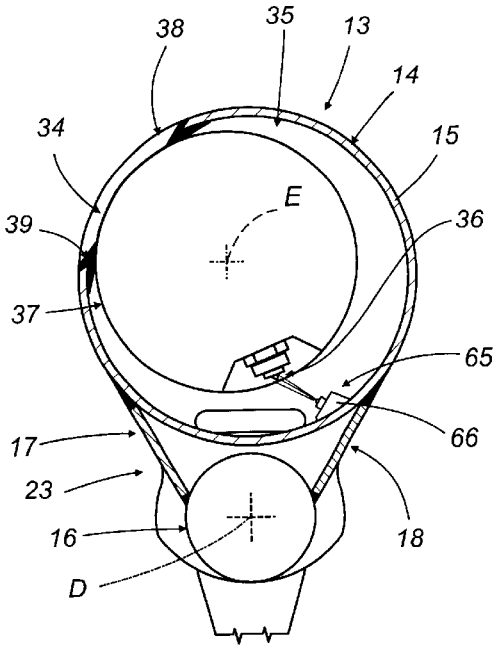

As illustrated in FIG. 9, in another embodiment, the dispenser device 13 has a silicone oil application station 65, comprising an element 66 for distributing the silicone oil on each of the adhesive dispenser nozzles 36, to prevent rapid drying of the adhesive substance. The silicone oil distribution element 66 is connected to silicone oil supply devices of the known type, not illustrated.

Figure 10:
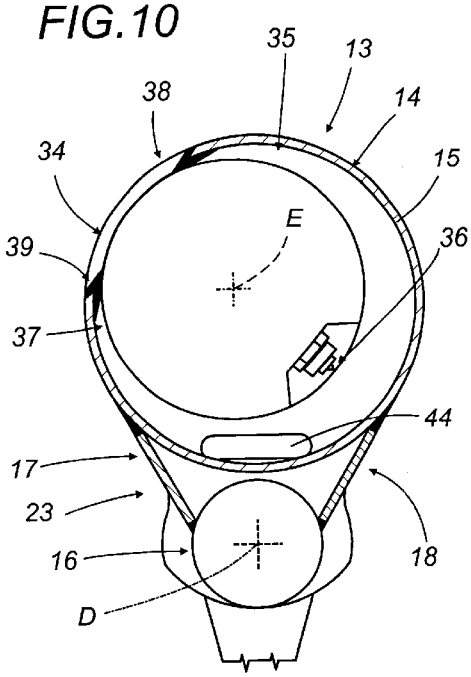

Advantageously, as illustrated in FIG. 10, in another embodiment, the dispenser device 13 may not have the above-mentioned washing fluid sprayers 42, since the dispenser nozzles 36 may be washed using a flow of washing fluid through the dispenser nozzles 36 themselves.

In other words, by supplying the dispenser part 34, during packaging machine non-operating steps, with washing fluid instead of the adhesive substances which normally circulates inside it, the dispenser nozzles 36 can be effectively washed.

Moreover, again with reference to the embodiment illustrated in FIG. 10, the nozzles 36 may be cleaned by making the dryable fluid flow from them into the sealed chamber 61, so that the nozzles 36 are also purged.

Similarly to the above description, with reference to FIG. 2, the residues of the washing and/or purging are collected by the outlet 44 and sent to the drainage pipe 59.

In addition to the features described relative to the last embodiment, during the packaging machine non-operating steps, the nozzles 36 may be made to continue operating inside the chamber 61. In this case, the chamber 61 holds the adhesive substance emitted by the nozzles 36, preventing the adhesive from dirtying the parts of the portion 1 of the above-mentioned packaging machine which are close to the station 12 and, at the same time, the nozzles 36 are less subject to the adhesive substance drying at the dispensing ends.

Finally, it must be emphasized that the embodiments described above are not necessary alternatives, but may be combined in a variety of ways according to different methods of washing and/or preventing the adhesive substance from drying on the nozzles 36.

What is claimed is:

1. A dispenser device for dryable fluids in a product packaging machine, the machine being of the type comprising a conveyor which feeds sheets of packaging material along a given feed path through a station which dispenses the fluids onto the sheets of material; and the device comprising a hollow body with at least one opening close to the dispenser station, at least one dispenser part which is at least partially inside the hollow body, the dispenser part having at least one dryable fluid dispenser nozzle; said hollow body and dispenser part being mobile relative to one another between an operating configuration, in which the nozzle is opposite the dispenser station through the opening and a non-operating configuration, in which the dispenser part and the hollow body form a sealed chamber housing the dispenser nozzle.

2. The device according to claim 1, further comprising sealing means inserted between the dispenser part and the hollow body to form the sealed chamber at least in the non-operating configuration.

3. The device according to claim 2, wherein the sealing means are arranged along the edge of the opening.

4. The device according to claim 3, wherein the dispenser part rotates about an axis and is mobile relative to this axis between the operating and non-operating configurations.

5. The device according to claim 4, wherein the hollow body oscillates about an axis that is parallel with the axis of rotation of the dispenser part and is mobile relative to the axis of oscillation between a first position, in which the opening is close to the dispenser part, forming the sealed chamber, and a second position, in which the opening is distanced from the dispenser part.

6. The device according to claim 5, further comprising at least one cleaning station for the dispenser nozzle located inside the sealed chamber.

7. The device according to claim 6, further comprising at least one washing station for the dispenser nozzle located inside the sealed chamber.

8. The device according to claim 7, wherein the washing station comprises at least one source of pressurized washing fluid directed at the dispenser nozzle located inside the sealed chamber.

9. The device according to claim 8, further comprising at least one station for application of silicone oil to the dispenser nozzle.

10. The device according to claim 9, further comprises at least one station for dispensing the dryable fluids inside the sealed chamber.

11. The device according to claim 10, wherein the dispenser part comprises a cylindrical manifold with a plurality of dispenser nozzles arranged in a line along a generatrix of the cylindrical manifold.

12. The device according to claim 11, wherein the hollow body comprises a substantially cylindrical shell, closed at its opposite ends, housing the cylindrical manifold and having the opening along a generatrix of the shell; the shell being supported by a first end of a rocker arm, oscillating about the axis of oscillation, the other end being connected to drive means.

13. The device according to claim 1, wherein the dispenser part rotates about an axis and is mobile relative to this axis between the operating and non-operating configurations.

14. The device according to claim 1, further comprising at least one cleaning station for the dispenser nozzle located inside the sealed chamber.

15. The device according to claim 1, further comprising at least one washing station for the dispenser nozzle located inside the sealed chamber.

16. The device according to claim 1, further comprising at least one station for application of silicone oil to the dispenser nozzle.

17. The device according to claim 1, further comprises at least one station for dispensing the dryable fluids inside the sealed chamber.

18. The device according to claim 1, wherein the dispenser part comprises a cylindrical manifold with a plurality of dispenser nozzles arranged in a line along a generatrix of the cylindrical manifold.

19. The device according to claim 5, wherein the hollow body comprises a substantially cylindrical shell, closed at its opposite ends, housing the cylindrical manifold and having the opening along a generatrix of the shell; the shell being supported by a first end of a rocker arm, oscillating about the axis of oscillation, the other end being connected to drive means.

20. The device according to claim 2, wherein the dispenser part rotates about an axis and is mobile relative to this axis between the operating and non-operating configurations.

* * * * *